United States Patent [19]

Goodrum et al.

[11] Patent Number: 4,724,960

[45] Date of Patent: Feb. 16, 1988

[54] GREENHOUSE FILM PACKAGE

[75] Inventors: Richard W. Goodrum, Richmond, Va.; James W. Wheeler, Brazil, Ind.

[73] Assignee: Ethyl Corporation, Richmond, Va.

[21] Appl. No.: 433,230

[22] Filed: Oct. 7, 1982

[51] Int. Cl.[4] ..... B65D 81/02; B65D 85/66

[52] U.S. Cl. ..... 206/397; 206/408; 206/586

[58] Field of Search ..... 206/397, 389, 408, 586, 206/823

[56] References Cited

U.S. PATENT DOCUMENTS

| | | | |
|---|---|---|---|
| 1,042,928 | 10/1912 | Kopf | 206/586 |
| 1,817,286 | 8/1931 | Beaman | 206/586 |
| 1,875,497 | 9/1932 | Richardson et al. | 206/586 |
| 1,991,616 | 2/1935 | Kondolf | 206/586 |
| 3,648,920 | 3/1972 | Stump | 206/586 |

FOREIGN PATENT DOCUMENTS

| | | | |
|---|---|---|---|
| 978904 | 12/1975 | Canada | 206/586 |
| 52-788 | 4/1977 | Japan | 206/586 |

*Primary Examiner*—Joseph M. Moy

*Attorney, Agent, or Firm*—Donald L. Johnson; John F. Sieberth

[57] ABSTRACT

A package for containing relatively long and relatively heavy rolls of polymeric film or the like comprising a container of a predetermined size and shape made of corrugated paper board or similar inexpensive materials with one or more fillets of a predetermined size and shape made of corrugated paper board, Styrofoam, foamed plastic or the like suitably affixed to the container at an appropriate place so as to provide a package which has the shape of a rectangular box and has vertical integrity when a plurality of the containers are stacked one upon the other.

The container may be a rectangularly shaped box or hollow hexahedron with fillets affixed to the internal surfaces thereof, a tubular shaped cylinder with fillets affixed to the exterior surface thereof or alternatively a triangularly shaped box or hollow pentahedron.

6 Claims, 6 Drawing Figures

GREENHOUSE FILM PACKAGE

BACKGROUND OF THE INVENTION

The present invention is in the general field of packaging and relates particularly to the packaging of long, relatively heavy, rolls of polymeric films.

Long, relatively heavy rolls of polymeric films are difficult to economically package in a manner such that the package is not destroyed during shipment from one locale to another. Packaging of such film is especially a problem where the package has several intermediate destinations, such as in the case of a distributor who first receives the product, stores it in his warehouse and then reships the package to the ultimate user. Although polymeric films are packaged in a variety of manner, low density polyethylene greenhouse films are generally packaged in widths from about 24 feet to 50 feet which are folded to about 6 feet to 12.5 feet and packaged in rolls of 100 feet or more and weighing from 50 to well over 100 pounds. Such rolls are typically packaged inrectangularly shaped boxes of corrugated paper board. Such type of packaging is generally preferred by a customer as the boxes can readily be stacked or be made readily accessible for inventory and also protect the film from dust. Additionally, disposal of the packages is relatively easy. When the overall length of such a rectangularly shaped box exceeds about 6 feet, the integrity of the box or package is very poor. The box or container structure is not sufficiently strong and the verticle side members of the box tend to collapse and do not retain vertical. In fact the sides become inclined at an angle from the vertical and thus have no supporting strength in the vertical direction. Once several such boxes are stacked on top of each other, all inclined at an angle to be vertical, the stack becomes unstable and has a strong tendency to topple or fall.

Another problem with a container or box of such size and shape is that the beam strength of the package lacks sufficient integrity. When one end of the box or package is lifted, there is a tendency for the center to sag and crinkle or otherwise distort the vertical sides of the boxes.

The foregoing problems destroy the box resulting in damage to the product, and unsightly appearance, returns by the customer and thus increases costs to the manufacturer.

It is therefore an important object of the present invention to provide a means for economically reinforcing the package or container so that the walls thereof have adequate structural integrity.

Another object of the invention is to improve the overall beam strength of the package.

The foregoing objectives are accomplished by providing fillets affixed to the walls of the container in an appropriate location externally of the roll of greenhouse film.

SUMMARY OF THE INVENTION

The present invention provides for a package of increased structural integrity for long, relatively heavy rolls of polymeric film comprising a container of a predetermined size and shape having preformed fillets affixed to the walls of the container and strategically positioned around the roll of film to provide a reinforced rectangular package. Fillets of various types, including triangular sections of box or paper board, premolded pentahedrons of styrafoam expanded synthetic resinous material, and foamed in place plastic are positioned between the roll of plastic film and the interior longitudinal corners of the container when the container is a box. Alternatively, the package may be a hollow cylinder or tube of a size for receiving the roll of film with fillets of a desired shape and size adhesively attached or otherwise affixed to the outside of the cylinder to provide a rectangular or box-like shaped package. Additionally, the container may be a triangularly shaped box or hollow pentahedron.

The construction designed to carry out the invention will be hereinafter described, together with other features thereof.

The invention will be more readily understood from a reading of the following specification and by reference to the accompanying drawings forming a part thereof, wherein examples of the invention are shown and wherein:

DESCRIPTION OF THE PREFERRED EMBODIMENTS

Figure 1:
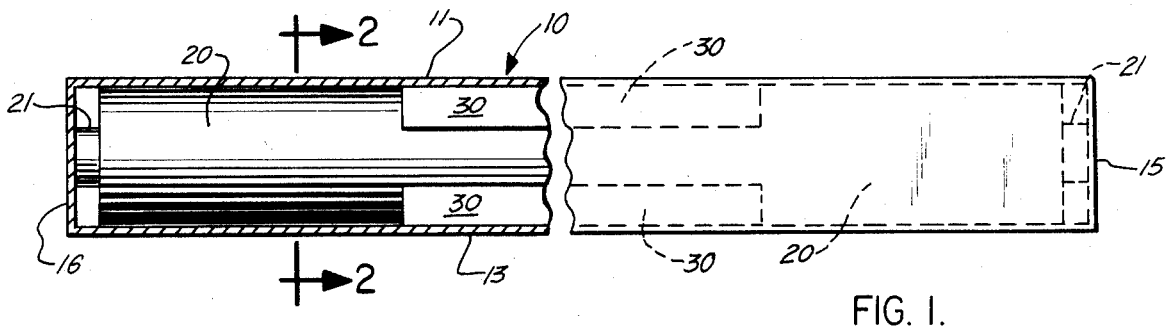
FIG. 1—A sectional view of a roll of greenhouse film positioned in a rectangularly shaped corrugated paper board box with triangularly shaped fillets in place.

Referring to the drawings wherein like characters of reference designate like parts throughout the several views, a rectangularly shaped container of box 10 is shown in FIG. 1 with a roll of greenhouse polymeric film 20 therein. The film 20 is wound or otherwise rolled on a winding core or axle 21. The box 10 is a rectangularly shaped container generally having four sides 11, 12, 13, and 14 of equal length and ends 15 and 16.

The box 10 is generally constructed of corrugated paper board with a casing wall thickness of about one-forth inch. Increasing the casing wall or side thickness to about one-half inch considerably increases the strength and structure of the box, but of course provides a more expensive box.

Figure 2:
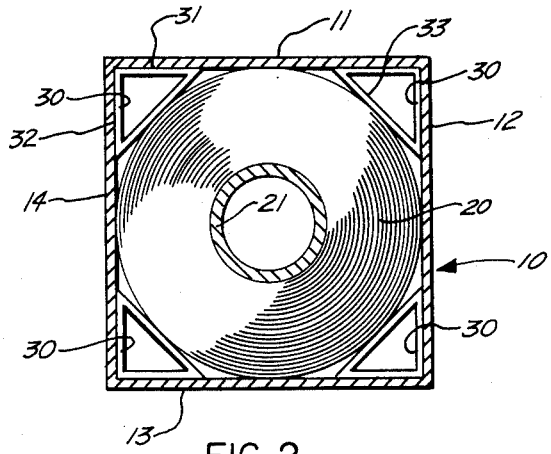
FIG. 2—A sectional view taken along line 2—2 of FIG. 1 showing the position of the fillets around the roll of film.

In order to prevent the walls of the box from becoming distorted when several boxes are stacked one upon the other, a plurality of fillets 30, preferably triangular in shape are affixed to the internal sides of the box 10 so as to be positioned around the roll of film 20 when the film is in position in the box. The fillets need not be as long as the box, but are merely placed in a strategic location within the box. The fillets 30 can be affixed to the box in a variety of means, but gluing at key points or areas 31 and 32 works very satisfactorily. Since it is the center of the box where problems are most likely to occur, positioning of the fillets in the center area of the box is particularly preferred. The position of the triangualarly fillets can readily be seen in FIGS. 1 and 2. It can be appreciated that the fillets 30 may be constructed of styrofoam or other type of plastic as well as corrugated paper board and that the side 33 of the fillet adjacent the roll of film may be curved to more or less match the surface of the roll of film 20 or it may be substantially straight as illustrated in FIG. 2. The relationship of the fillets 30 to the roll 20 should be such that when the roll is positioned in the box the sides 33 of the fillets 30 are in contact or are substantially adjacent to the outer edge of the roll of film 20. The fillets 30 may be made of any suitable type materials; however, since such boxes are generally destroyed and are not reused, construction materials should be as inexpensive as available and as suitable.

Figure 3:
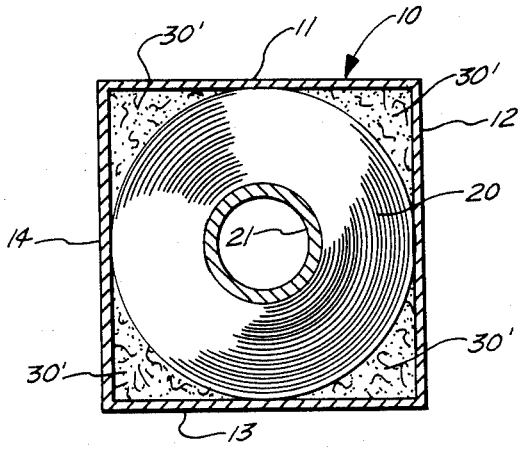
FIG. 3—A cross-sectional view similar to that of FIG. 2 illustrating foamed-in-place fillets.

In FIG. 3, the fillets 30' are foamed-in-place expanded synthetic resinous material or other suitable plastic. In this packaging arrangement, the film 20 is placed within the box 10 and the resinous material foamed in place in strategic locations around the greenhouse film roll 20.

Figure 4:
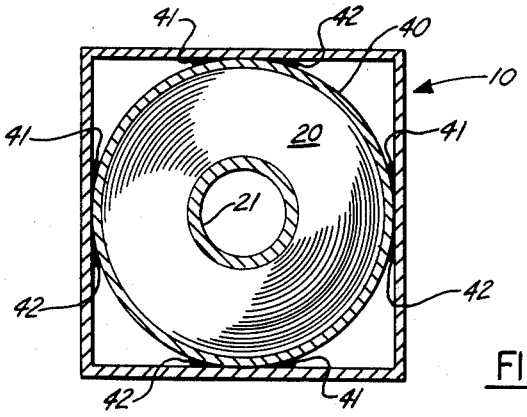
FIG. 4—A cross-sectional view similar to that of FIG. 2 illustrating fillets comprising sections of tubular material affixed to the inside of the corrugated paper board box.

Referring now to FIG. 4, inside the interior of the box 10 are strategically positioned therein short tubes or open end cylinders 40 which are affixed to the box 10 and at appropriate points or areas 41, 42, so that the tubes 40 are firmly affixed to the interior sides of the box 10. Again, the tubes 40 may be the entire length of the box 10, but in the interest of economics, it is generally preferable to have a short tube 40 positioned at each end of the box and in the center therof. In some instances, a short tubular fillet in the center of the box is adequate.

Figure 5:
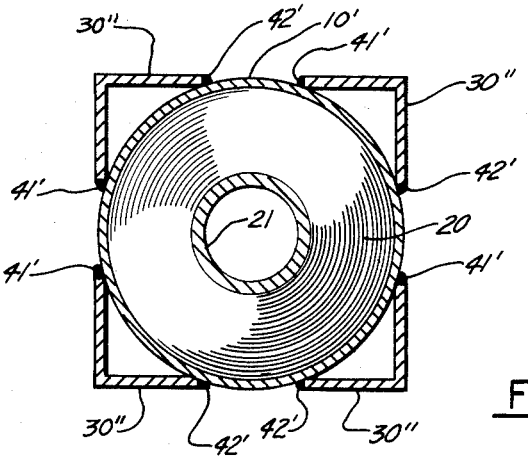
FIG. 5—A cross-sectional view similar to that of FIG. 2 illustrating external fillets affixed to a continuous tube or cylinder.

In FIG. 5, the basic package for the film 20 is a tubular package or cylinder 10" within which the film 20 is inserted and around the exterior sides of the cylinder 10" are positioned angularly shaped fillets 30" which are strategically affixed to the tube 10' by glueing or other suitable means in the areas 41' and 42'. If desired, of course, the fillets 30' may be complete triangles or pentahedrons rather than the two-sided angular members illustrated. Again, sucb fillets 30" are preferably made from corrugated paper board, or styrofoam or other similar inexpensive type materials.

Figure 6:
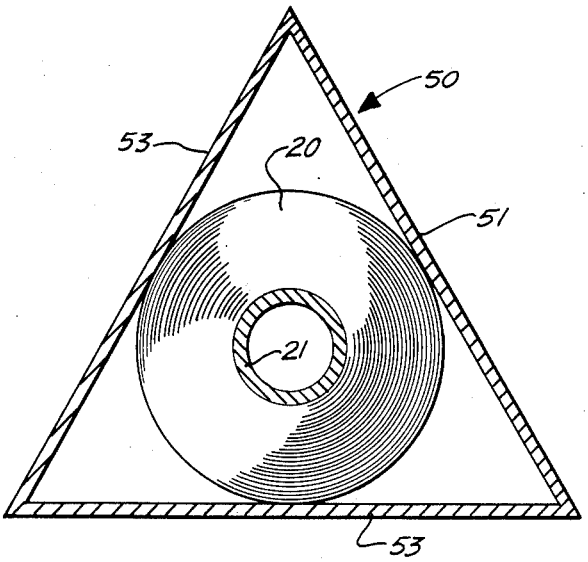
FIG. 6—A cross sectional view illustrating a triangular shaped box with a roll of greenhouse film positioned therein.

As seen in FIG. 6, an alternate type of package is illustrated, wherein the package 10" is a pentahedron or triangularly shaped box 50 having sides 51, 52, and 53. The interior size of the triangular shaped box is such that the roll of film 20 is adjacent to each of the sides of the box and more or less tangential therewith.

It can be appreciated that various shapes, sizes and materials may be used in carrying out the present invention. It is preferable in each case however to attach or otherwise affix the fillets to the sides of the box. Such fillets may vary in length from a few inches in the center of the box to the entire length of the box. The fillets may also be interrupted along the length of the box. The fillets may be external to a continuous tube surrounding the roll as illustrated in FIG. 5. In such case, the fillets provide a means to enable the rolls to be stacked one on top of the other which makes for easy inventorying and economical use of warehouse space. A preferred length of the fillets is about as long as the center one-third of the length of the container.

The foregoing disclosure and description of the invention is illustrative and explanatory thereof and various changes in the illustrated package may be made within the scope of the appended claims without departing from the spirit of the invention.

What is claimed is:

1. A package for containing relatively long and relatively heavy rolls of polymeric film or the like, comprising a rectangularly shaped box or hollow hexahedron having at least four lineal triangularly shaped fillets of a predetermined size affixed within the interior sides of the box, each of said fillets being positioned opposite each other and affixed to an internal longitudinal corner substantially in the center of the box in such a manner that when a roll of film is positioned in the box, the external surface of the roll of film is adjacent to each of said fillets.

2. The package of claim 1, wherein said fillets are triangularly shaped tubes of paperboard or the like.

3. The package of claim 1, wherein said fillets are premolded styrofoam or the like pentahedrons.

4. The package of claim 1, wherein said box is constructed of corrugated paper board.

5. The package of claim 1, wherein said box is constructed of corrugated paper board of a thickness of about one-half inch.

6. The package of claim 1, wherein said fillets are constructed of styrofoam or like plastic.

* * * * *